US008721110B2

(12) United States Patent
Luo

(10) Patent No.: US 8,721,110 B2
(45) Date of Patent: May 13, 2014

(54) LED EXPLOSION-PROOF LIGHT

(75) Inventor: Jiaming Luo, Guangdong Province (CN)

(73) Assignee: Shen Zhen Nibbe Optoelectronic Technology Co., Ltd, Guangdong Province (CN)

( * ) Notice: Subject to any disclaimer, the term of this patent is extended or adjusted under 35 U.S.C. 154(b) by 167 days.

(21) Appl. No.: 13/451,546

(22) Filed: Apr. 20, 2012

(65) Prior Publication Data

US 2013/0027917 A1 Jan. 31, 2013

(30) Foreign Application Priority Data

Jul. 26, 2011 (CN) ..... 2011 2 0264987 U

(51) Int. Cl.

| | |
|---|---|
| ***F21L 4/00*** | (2006.01) |
| ***F21V 25/12*** | (2006.01) |
| ***F21V 29/00*** | (2006.01) |
| ***F21V 31/00*** | (2006.01) |
| ***F21L 4/02*** | (2006.01) |
| *F21V 1/00* | (2006.01) |

(52) U.S. Cl.

CPC ..... *F21L 4/027* (2013.01); *F21L 15/06* (2013.01); *F21V 25/12* (2013.01); *F21V 31/005* (2013.01); *F21V 29/2231* (2013.01)

USPC ..... 362/186; 362/158; 362/267; 362/294

(58) Field of Classification Search

CPC ..... F21L 4/00; F21L 11/00; F21L 15/06; F21L 4/027; F21L 7/00; F21S 9/02; F21S 9/00; F21V 31/00; F21V 31/03; F21V 29/00; F21V 29/002; F21V 29/004; F21V 29/22; F21V 29/2206; F21V 29/2212; F21V 29/2218; F21V 29/2225; F21V 29/2231; F21V 25/12; F21V 31/005; F21V 15/01; F21V 15/011; F21V 23/002; F21V 5/00; F21K 9/00; F21K 9/10; F21K 9/13; F21Y 2111/001; F21Y 2101/02

USPC ..... 362/158, 186, 267, 294, 373; 313/46

See application file for complete search history.

(56) References Cited

U.S. PATENT DOCUMENTS

| | | | | |
|---|---|---|---|---|
| 7,008,084 | B2 * | 3/2006 | Galli | 362/373 |
| 7,303,301 | B2 * | 12/2007 | Koren et al. | 362/101 |
| 7,726,844 | B2 * | 6/2010 | Chen | 362/294 |
| 8,172,434 | B1 * | 5/2012 | Olsson | 362/346 |
| 2008/0304267 | A1 * | 12/2008 | Lin | 362/294 |

* cited by examiner

*Primary Examiner* — Alan Cariaso

(57) ABSTRACT

An LED explosion-proof light comprises a front casing, a light source support disposed at a center of a space enclosed by the front casing, and cooling plates disposed between the front casing and the light source support; the cooling plates are in railing shape; a power supply is electrically connected with light emitting components in the light source support. The light emitting components comprise: an LED chip integrally packaged on a front side of a metal base panel; back of the metal base panel is securely attached to a light source backing panel, and their contact surface is applied with high-performance cooling cream. Lens components are disposed at a front side of the LED chip.

5 Claims, 4 Drawing Sheets

LED EXPLOSION-PROOF LIGHT

BACKGROUND OF THE INVENTION

The present invention relates generally to explosion proof lighting apparatus and specifically relates to an LED explosion-proof light.

Improvements in semiconductor materials and semiconductor packaging technology provides an excellent technological background for developing high brightness LEDs especially W-class white lights for lighting purposes. LEDs have become more and more popular due to their gradual improvements in luminous flux and light emission efficiency, gradual reduction in production costs, and also their advantage rested in energy reservation and environmental friendliness. In recent years, developments of LEDs are extremely rapid.

An LED light is generally configured to comprise light casing, light source (LED module), lens and power supply etc. Junction temperature of an LED chip is one of the crucial factors which affect the life of lighting apparatus. Therefore, LED light is generally designed to comprise heat conduction components and cooling components so that heat of the chip is conductively transmitted away and dispersed. Heat conduction components and cooling components are particularly important to high power LED lights, especially those required for long time continuous lighting. Therefore, enhancing heat conduction ability and cooling effect, reducing junction temperature of the chip and prolonging the life of lighting apparatus are the key technologies that high power LED lights need to breakthrough the most.

BRIEF SUMMARY OF THE INVENTION

In view of the aforesaid disadvantages now present in the prior art, the present invention provides an LED explosion-proof light to remedy the failure of fast and sufficient heat conduction between a light source and an outer casing of the LED explosion-proof light, and to remedy poor cooling effect of the outer casing of the light.

The above objects are attained as follows:

An LED explosion-proof light, characterized in that it comprises:

a front casing 8 which encloses a space, wherein a light source support 99 for installing light emitting components is disposed at a center of the space;

a plurality of cooling plates 81 disposed between the front casing 8 and the light source support; wherein the cooling plates 81 are arranged in radial pattern with the light source support as their center point while they leave gaps running through along a front side to a rear side of the front casing 8; and a power supply box 12 with a built-in power supply 15 disposed on a rear side of the front casing 8; wherein the power supply 15 and the light emitting components are electrically connected;

the light emitting components comprise an LED chip 5, a metal base panel 51 and lens components, wherein:

back of the metal base panel 51 is securely attached to a light source backing panel 6 with high heat conductivity, and their contact surface is applied with high-performance cooling cream; and lens components are disposed at a front side of the LED chip 5.

Based on the above technical features, the light source backing panel 6 is fixed on the light source support by first screws 7 and first spring washers 34;

the metal base panel 51 is fixed on the light source base panel 6 by another set of first screws 7 and first spring washers 34.

Based on the above technical features, the light source backing panel 6 is 1-10 mm thick, 60-100 mm in diameter, and disposed with a plurality of through holes thereon;

the metal base panel 51 is 1-10 mm thick.

Based on the above technical features, the light source backing panel 6 is 1-5 mm thick, and the metal base panel 51 is 1-5 mm thick.

Based on the above technical features, the lens components comprise: a lens rubber ring 2, a lens 3 and a lens water-proof ring 4 disposed in sequential order from front to back; the lens water-proof ring 4 contacts with the light source support; a decorative ring 1 connects with screw threads of the light source support and compresses the lens rubber ring 2, the lens 3 and the lens water-proof ring 4 to achieve sealing.

Based on the above technical features, the lens components comprise: a lens rubber ring 2, a lens 3 and a lens water-proof ring 4 disposed in sequential order from front to back; the lens water-proof ring 4 contacts with the light source support: a decorative ring 1 compresses the lens rubber ring 2, the lens 3 and the lens water-proof ring 4 to achieve sealing; the decorative ring 1 is fixed on the front casing 8 by second spring washers 9 and second screws 10.

Based on the above technical features, the LED chip 5 is electrically connected to the power supply 15 via a power wire 32; the power wire 32 is accommodated in a varnished tube 33, and the power wire 32 exits in a sealed condition when it passes through the power supply box 12, the light source backing panel 6 and the LED chip 5.

According to the LED explosion-proof light of the present invention, by integral packaging of the LED chip on the metal base board 51 with high heat conductivity, and by simply adding a light source backing panel 6 with high heat conductivity, internal heat energy transfer could be effectively completed without interruption and without delay. By utilizing cooling plates designed as radial railing form in the outer casing, the front casing is opened at the top and the bottom, thereby enabling the formation of convective air current. By means of the above internal and external features, cooling system of the present invention could have its advantages being more fully utilized. Besides, the present invention attains more effective cooling effect by just a very little increase in costs, and significantly enhances the light's life.

BRIEF DESCRIPTION OF THE DRAWINGS

The present invention is accompanied by the following drawings.

DETAILED DESCRIPTION OF THE INVENTION

The present invention is further explained in detail below with reference to the accompanying drawings.

Figure 1:
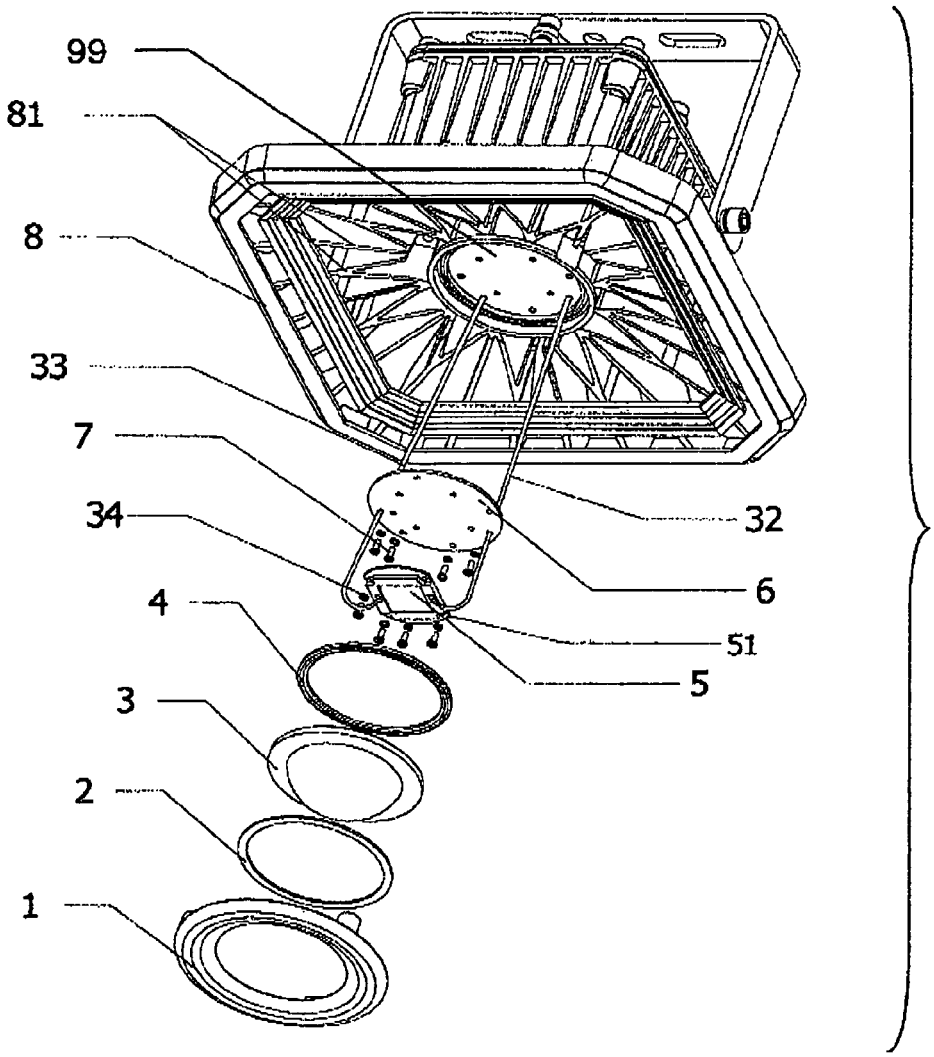
FIG. 1 is a schematic exploded structural view of a front casing section of the explosion-proof light.
Figure 2:
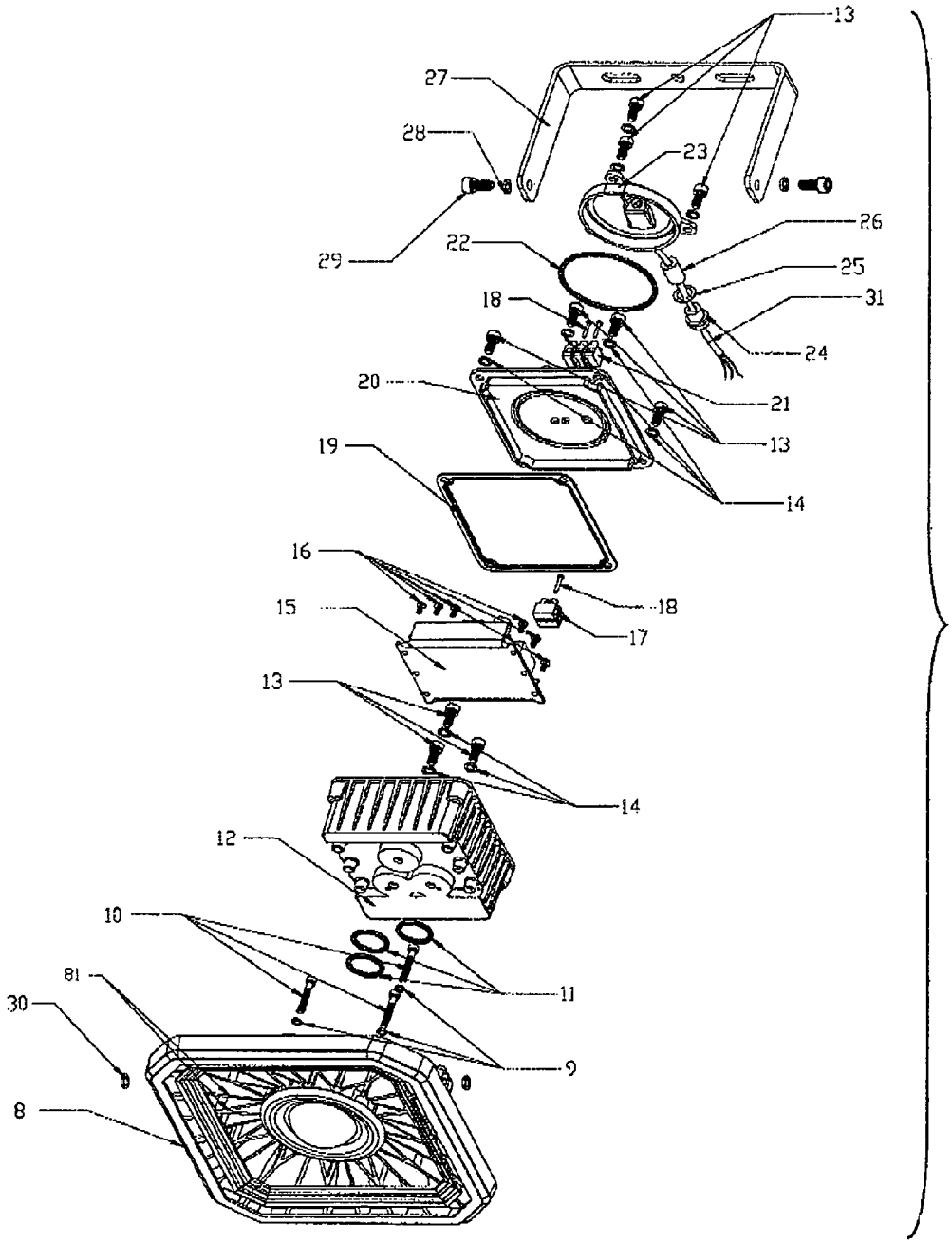
FIG. 2 is a schematic exploded structural view of a power supply box section of the explosion-proof light.
Figure 5:
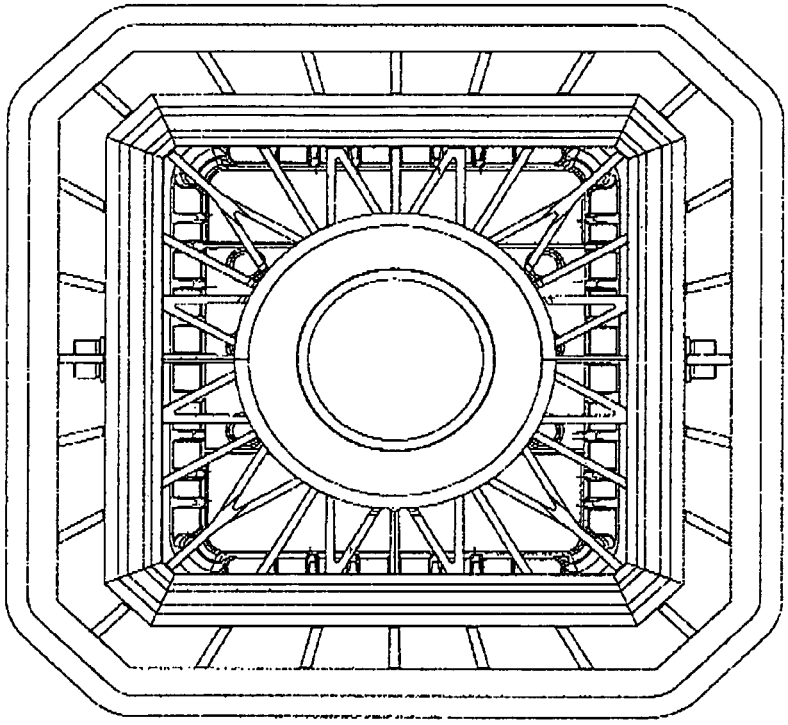
FIG. 5 is a front view of the front casing.

As shown in FIGS. 1, 2 and 5, an LED explosion-proof light according to the present invention comprises:

a front casing 8 enclosing a space, wherein the front casing 8 could be a chamfered rectangle as in FIGS. 1 and 5, or other suitable shapes such as a circle, a hexagon or an octagon etc.

a light source support 99 for installing light emitting components is disposed at a center of the space;

a plurality of cooling plates 81 disposed between the front casing 8 and the light source support; wherein the cooling plates 81 are arranged in radial pattern with the light source support as their center point while they leave gaps running through along a front side to a rear side of the front casing 8, as shown in FIG. 5; and a power supply box 12 with a built-in power supply 15 disposed on a rear side of the front casing 8; wherein the power supply 15 and the light emitting components are electrically connected.

The front casing 8 is made of highly heat conductive aluminum by integral die-casting, resulting in reduction of contact surfaces and heat resistance, and therefore better heat conduction. A middle part of the front casing 8 is hollowed out as cooling plates 81 arranged as radial railings in a network form with their outer ends connected to an inner wall of the front casing 8 and their inner ends connected to an outer wall of the light source support. By forming a convective current by rising hot air and replenishment of cool air from below the light, heat energy from the chip could be dispersed quickly.

Figure 3:
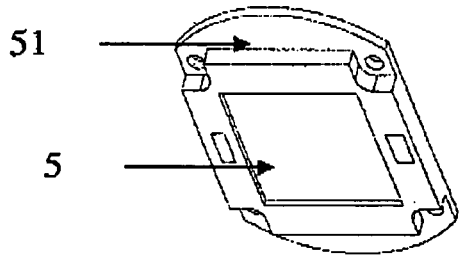
FIG. 3 is a schematic view of an LED light source.
Figure 4:
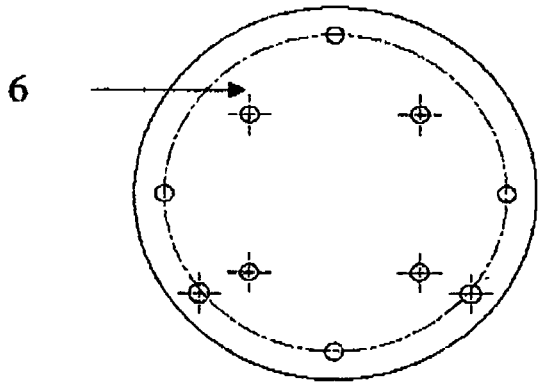
FIG. 4 is a plan view of a light source backing panel.

Based on the above technical features, the light emitting components comprises the following as shown in FIGS. 1, 3 and 4:

an LED chip 5 integrally packaged on a front side of a metal base panel 51 with high heat conductivity; and back of the metal base panel 51 is securely attached to a light source backing panel 6 with high heat conductivity, and their contact surface is applied with high-performance cooling cream.

The metal base panel 51 and the light source backing panel 6 could both be made of red copper.

The light source backing panel 6 is fixed on the light source support by first screws 7 and first spring washers 34. The metal base panel 51 is fixed on the light source base panel 6 by another set of first screws 7 and first spring washers 34. Four first screws 7 are used respectively for fixing the metal base panel 51 and the light source backing panel 6 in an embodiment shown in FIG. 1.

The light source backing panel 6 is 1-10 mm thick, preferably 1-5 mm thick. Its diameter is 60-100 mm, and disposed with a plurality of through holes thereon.

The metal base panel 51 is 1-10 mm thick, preferably 1-5 mm thick.

Lens components are disposed at a front side of the LED chip 5.

The most inventive step of the present invention is that, although there is one additional metal base panel 51 made of red copper and also one additional light source backing panel 6 made of red copper, heat energy flow is nonetheless faster and unilateral conduction ability is enhanced. The LED chip 5 is therefore benefited with its junction temperature quickly reduced by rapid heat absorption, conduction and dispersion.

Based on the above technical features, the lens components comprise the following as shown in FIGS. 1 and 2: a lens rubber ring 2, a lens 3 and a lens waterproof ring 4 disposed in sequential order from front to back. The lens water-proof ring 4 contacts with the light source support. A decorative ring 1 connects with screw threads of the light source support and compresses the lens rubber ring 2, the lens 3 and the lens water-proof ring 4 to achieve sealing.

Alternatively, the lens components comprise: a lens rubber ring 2, a lens 3 and a lens water-proof ring 4 disposed: in sequential order from front to back. The lens water-proof ring 4 contacts with the light source support. A decorative ring 1 compresses the lens rubber ring 2, the lens 3 and the lens water-proof ring 4 to achieve sealing. The decorative ring 1 is fixed on the front casing 8 by second spring washers 9 and second screws 10. Three second screws 10 are used in an embodiment shown in FIG. 2.

Based on the above technical features, FIGS. 1 and 2 as shown reveal that the LED chip 5 is electrically connected to the power supply 15 via a power wire 32; the power wire 32 is accommodated in a varnished tube 33, and the power wire 32 exits in a sealed condition when it passes through the power supply box 12, the light source backing panel 6 and the LED chip 5. The power wire 32 exits in a sealed condition to satisfy safety requirements for explosion-proof light.

In comparison with existing cooling technology, the present invention has the following characteristics: a bottom of the packaged chip of an LED light source of the present invention is securely attached to a metal base panel 51 which serves as heat conduction base panel, and a tight source backing panel 6 crucial to heat conduction and made of red copper is disposed in between the cooling plates 81 in the front casing and the metal base panel 51. This is like paving a highway between the chip and the cooling plates, enabling fast and effective transfer of heat via such a highway from the chip onto the cooling plates where the heat is dispersed. Besides, the front casing is configured to be made of highly heat conductive aluminum by integral die-casting; in order to incorporate convective air current mechanism, the front casing is hollowed out as cooling plates arranged as radial railings in a network form with their one ends connected to an inner wall of a front end surface of the front casing and their other ends connected to an outer wall of the light source support at a rear end surface of the front casing. Accordingly, not only cooling surface area is enlarged, but also by forming a convective current by rising hot air and replenishment of cool air from below the light, heat energy from the chip is also ensured to be dispersed quickly.

By simply adding a metal base panel 51 and a light source backing panel 6, internal heat energy transfer could be effectively completed without interruption and without delay. Also, cooling plates designed as radial railing form in the outer casing are used. By means of the above internal and external features, cooling system of the present invention could have its advantages being more fully utilized. Besides, when compared with the total cost of high power LED explosion-proof light, the present invention attains more effective cooling effect by just a very little increase in costs, and significantly enhances the light's life.

FIG. 3 is a schematic view of the LED light source. The metal base panel at the bottom of the packaged chip of the LED light source is a metal base panel 51 made of red copper. Dimension of the metal base panel 51 could change subject to changes in packaging dimension. The metal base panel 51 securely contacts with the light source backing panel. The above technology relating to connection between the bottom of the packaged chip and the metal base panel 51 or other highly heat conductive metal plates resulting in formation of an integral structure should also fall within the scope of protection of the present invention.

FIG. 4 is a plan view of the light source backing panel. In an embodiment as shown by the figure, the light source backing panel is in circular shape, 68 mm in diameter, 2 mm thick and made of red copper. Its fixing position at the front casing is shown in FIGS. 1 and 2. One side of the light source backing panel securely contacts with the light source support, and another side of which securely contacts with the metal base panel 51.

FIG. 5 is a front view of the front casing. The front casing is made of highly heat conductive aluminum by integral die-casting, also, in order to incorporate convective air current mechanism, the front casing is hollowed out as cooling plates arranged as radial railings in a network form with their one ends connected to an inner wall of a front end surface of the front casing and the other ends of which connected to an outer wall of the light source support at a rear end surface of the front casing. Accordingly, not only cooling surface area is enlarged, but also by forming a convective current by rising hot air and replenishment of cool air from below, heat energy from the chip is also ensured to be dispersed quickly.

A key inventive step of the present invention is as follows: the LED chip is integrally packaged on the metal base panel 51, and at the same time, a light source backing panel made of red copper is disposed in between the LED chip and the cooling plates. By utilizing highly heat absorptive and highly heat conductive characteristics of red copper, heat energy of the chip is absorbed quickly and transferred onto the cooling plates; also, by utilizing good cooling ability of the cooling plates arranged as radial railings in network form in the casing, heat energy is quickly dispersed away. High power LED lights similar to the present invention, for example, tunnel lights, flood lights, and road lights etc., could also use the above technology for cooling optimization. However, various LED lights made by adding red copper materials or other highly heat conductive metal materials between the LED light source and the outer casing for heat energy transfer from the chip to the cooling plates should fall within the scope of protection of the present invention. Also, LED lights made by using cooling plates designed to be arranged as radial railings in a network form in the outer casing while leaving gaps running through along a front side to a rear side of the front casing 8 should also fall within the scope of protection of the present invention.

Based on the above technical features, reference is made to FIG. 2: the power supply box 12 is fixed on the rear side (rear end surface) of the front casing 8 by power connection wire, water-proof rings 11, third screws 13 and third spring washers 14; the power supply 15 is fixed inside the power supply box 12 by fourth screws 16; a 2p connection wire terminal 17 is fixed on a flange of the power supply box 12; connect the power wire 32 with the 2p connection wire terminal 17 to attain a conductive status of electrical connection between the power supply 15 and the light emitting components; the power supply 15 has a twin core conduction wire (not shown in the figure) connected to the 2p connection wire terminal 17.

Based on the above technical features, reference is made to FIG. 2: the power supply box 12 is disposed with a power supply cover 20; an end surface of the power box 12 is disposed with a power supply water-proof ring 19; the power supply 15 has a triple core conduction wire (not shown in the figure) passing through the power supply cover 20 and connected with a 3p connection wire terminal 21.

The power supply cover 20 is fixed on an end surface of the power supply box 12 by another set of third screws 13 and third spring washers 14, thereby attaining sealing effect. The 3p connection wire terminal 21 is fixed on the power supply cover 20 by another set of fifth screws 18.

An upper surface of the power supply cover 20 is disposed with a circular recess. A power supply box top cover water-proof ring 22 is installed inside the circular recess of the power supply cover 20. A cable wire 31 enters through a through hole on a power supply box top cover 23 through a screw 24, a screw water-proof ring 25 and an elastic rubber cushion 26 and connects with another side of the 3p connection wire terminal 21 to achieve a conductive status between an external power wire and the power supply 15.

The power supply box top cover 23 is fixed on the power supply cover 20 by another set of third screws 13 and third spring washers 14 and compresses the power supply box top cover water-proof ring 22 to achieve sealing.

Rounded teeth rings 30 are respectively installed inside two holes each on a side of the casing. A support 27 is connected with the casing 8 by fourth spring washers 28 and sixth screws 29.

What is claimed is:

1. An LED explosion-proof light, characterized in that it comprises:

a front casing (8) which encloses a space, wherein a light source support for installing light emitting components is disposed at a center of the space; a plurality of cooling plates (81) disposed between the front casing (8) and the light source support; wherein the cooling plates (81) are arranged in radial pattern with the light source support as their center point while they leave gaps running through along a front side to a rear side of the front casing (8); and a power supply box (12) with a built-in power supply (15) disposed on a rear side of the front casing (8); wherein the power supply (15) and the light emitting components are electrically connected;

the light emitting components comprise an LED chip (5), a metal base panel (51) and lens components, wherein:

the LED chip (5) is integrally packaged on a front side of the metal base panel (51) with high heat conductivity;

back of the metal base panel (51) insecurely attached to a light source backing panel (6) with high heat conductivity, and their contact surface is applied with high-performance cooling cream; and lens components are disposed at a front side of the LED chip (5);

the lens components comprise: a lens rubber ring (2), a lens (3) and a lens water-proof ring (4) disposed in sequential order from front to back; the lens water-proof ring (4) contacts with the light source support; a decorative ring (1) connects with screw threads of the light source support and compresses the lens rubber ring (2), the lens (3) and the lens water-proof ring (4) to achieve sealing.

2. The LED explosion-proof light as in claim 1, characterized in that, the light source backing panel (6) is fixed on the light source support by first screws (7) and first spring washers (34);

the metal base panel (51) is fixed on the light source backing panel (6) by another set of first screws (7) and first spring washers (34).

3. The LED explosion-proof light as in claim 1 or 2, characterized in that, the light source backing panel (6) is 1-10 mm thick, 60-100 mm in diameter, and disposed with a plurality of through holes thereon;

the metal base panel (51) is 1-10 mm thick.

4. The LED explosion-proof light as in claim 3, characterized in that, the light source backing panel (6) is 1-5 mm thick, and the metal base panel (51) is 1-5 mm thick.

5. The LED explosion-proof light as in claim 1 or 2, characterized in that, the LED chip (5) is electrically connected to the power supply (15) via a power wire (32); the power wire (32) is accommodated in a varnished tube (33), and the power wire (32) exits in a sealed condition when it passes through the power supply box (12), the light source backing panel (6) and the LED chip (5).

* * * * *